US005766102A

United States Patent [19]

Lawson et al.

[11] Patent Number: 5,766,102

[45] Date of Patent: Jun. 16, 1998

[54] TRAINING DEVICE FOR BATTERS

[76] Inventors: Steven R. Lawson, 309 N. Wilson Cir., Boise, Id. 83706; Raymond J. Lawson, S.R. 2-1851-Ln. 2, Burns, Oreg. 97720

[21] Appl. No.: 820,459

[22] Filed: Mar. 17, 1997

[51] Int. Cl.[6] ..... A63B 69/40

[52] U.S. Cl. ..... 473/428

[58] Field of Search ..... 473/426, 428, 473/430

[56] References Cited

U.S. PATENT DOCUMENTS

| | | | |
|---|---|---|---|
| 3,825,259 | 7/1974 | Burchett | 273/29 A |
| 4,138,107 | 2/1979 | Janis | 473/428 |
| 4,632,394 | 12/1986 | Ryan | 273/26 E |
| 4,732,382 | 3/1988 | Ratner | 273/29 A |
| 4,735,413 | 4/1988 | Yamanouchi | 473/426 |
| 4,993,709 | 2/1991 | Tominaga | 473/430 |
| 5,040,791 | 8/1991 | Ratjac | 473/426 |
| 5,072,937 | 12/1991 | Zarate | 473/426 |
| 5,340,101 | 8/1994 | Lawson | 473/426 |
| 5,386,986 | 2/1995 | Gamboa | 473/430 |
| 5,419,550 | 5/1995 | Blom | 473/428 |
| 5,458,326 | 10/1995 | Marcys | 473/426 |
| 5,588,646 | 12/1996 | Dickson | 473/426 |
| 5,624,113 | 4/1997 | Rabine | 473/430 |

*Primary Examiner*—Theatrice Brown
*Attorney, Agent, or Firm*—Joseph W. Holland

[57] ABSTRACT

A training device for batters which aids a batter in practicing and developing the batting swing including an upright member having a number of arm engagement fittings. The upright member has a horizontal member attached at approximately its midpoint, for supporting the device on a support structure, typically a toprail of a fence. The upright member is secured to the fence or other support structure by a tensionable strap. A horizontal arm is removably mountable in any of the vertically oriented arm engagement mechanisms. A tether depends by its first end from the horizontal arm. A ball is slideably adjustable along the tether. The second end of the tether is attached to the support structure to limit travel of the ball and tether. Because the training device for batters has a number of locations along the length of the upright member at which the horizontal arm member is mountable, the device may be attached to and used on support structures having a variety of heights. In addition the device includes an adapter which allows the training device to be surface mounted on a variety of support structures.

8 Claims, 7 Drawing Sheets

TRAINING DEVICE FOR BATTERS

FIELD OF THE INVENTION

The present invention relates generally to devices which aid batters in the practicing and developing their swing and more specifically to a device which is durable, portable, adjustable and which may be used by batters of various sizes, supported on fences or other supports of varying height.

BACKGROUND OF THE INVENTION

When we were young, baseball was king. Starting in the spring, baseball was a fever that every kid on the block, every kid we knew caught. At school we played baseball at recess and practiced for little league after school. As the school year neared its end, a commonly observed symptom of spring fever was spending classroom hours gazing out a window and thinking of summer, of those days of being outdoors and baseball. When June finally rolled around my brothers and our friends breathed baseball. We played catch, over-the-line, and homerun derby. We played in the little league and the church league. We traded baseball cards and listened to Dizzy and PeeWee call the play by play for the game of the week. When Grandpa came from Detroit he'd talk about the Tigers. He'd take us to the night games for the local 1-AA club. Baseball was everything and all.

Down the street from the house where we grew up were vacant lots, acres and acres, once agricultural and now lying on the fringe of urban sprawl. Back in among the weeds and along the creek there was an endless supply of river rock sized to perfection, more or less spherical, with an average diameter of one to one and a half inches and each stone weighing approximately the same as a baseball. On many a hot July and August afternoon, we headed over to the vacant lots with a friend or two. First we'd find the perfect stick and each one of us would have to have their own. Two and a half to three feet long, tapered from end to end, three to four inch diameter on the big end and one to two on the small end. The harder the better. Then off to the gravel pile to practice hitting. We could spend hours hitting rocks. Line drive, fly ball, bee line and home run. In the distance was a set of power lines and over the top was out of the park. Cheap seats.

Today one wonders how batting skills are developed. Where do youngsters go to hone the eye-hand coordination required for hitting? Where do they go to get the feel of stepping into a pitch and making good solid contact with a ball?

Most batting practice today is had either at a batting cage, where skills are developed with the use of costly pitching machines, or in batting drills at practice. While each method contributes to a batter's proficiency, each of these methods also have their limitations. Time in a batting cage is expensive. Time at practice is limited and must be shared among all the players.

A number of devices have been disclosed for allowing the novice as well as the expert access to hitting practice which does not require great expense or the participation of others.

Ryan, U.S. Pat. No. 4,632,394 discloses a ball on upper and lower tethers each hooked to a baseball backstop.

Lawson, U.S. Pat. No. 5,340,101 discloses a device for support on a fence or other upright structure including an arm, a diagonal support brace for the arm and a ball tethered to the arm with retention means for limiting travel of the tether.

Like batting cages and baseball practice, each of these devices have their limitations. For instance, in order to use the device disclosed in Ryan, a backstop is required. The device disclosed in Lawson, while providing a number of desirable features, has been found to lack an adequate range of versatility, specifically with regard to the user's ability to employ the device on a number of common fence heights found at ball parks and in yards. The device disclosed in Lawson is limited in that it is configured to allow use of the apparatus only on fences having a height of approximately six feet and having a toprail. Additionally, it has been found that improvements can be made in the manner in which the ball is attached to the tether in order to improve the durability of the device. Finally, it has been found that an adapter allows the use of the training device for batters on an even wider range of fences and surfaces.

SUMMARY OF THE INVENTION

The present invention is directed to a device which aids a batter in practicing and developing their batting swing. More specifically, the present invention is directed to a device including an upright member having a number of vertically oriented arm engagement fittings disposed along its length. A horizontal arm member is removably mountable in any of the vertically oriented arm engagement fittings. A tether depends by its first end from the horizontal arm. A slideably adjustable ball is attached along the tether. The second end of the tether is attachable to a fixed object, typically the fence, to limit travel of the ball and tether. The upright member is configured having attached at approximately its midpoint and transverse to the axis of the upright member, a cross member for engaging the horizontal toprail of a fence.

The training device for batters is mountable on a toprail of a fence having a toprail height of anywhere from four to ten feet or more. The device is secured to the fence and depending upon the height of the fence toprail the horizontal arm is positioned so that it engages one of the vertically oriented arm engagement mechanisms and extends from the upright. The ball height is adjusted along the tether, the second end of the tether is secured and batting begins.

Alternatively, the device may be mounted to the face of a fence, or surface mounted on any of a variety of support structures utilizing an adapter.

These and other features of the invention will be more fully understood and appreciated with reference to the following description, the claims and the accompanying drawings.

DETAILED DESCRIPTION OF THE INVENTION

Figure 1:
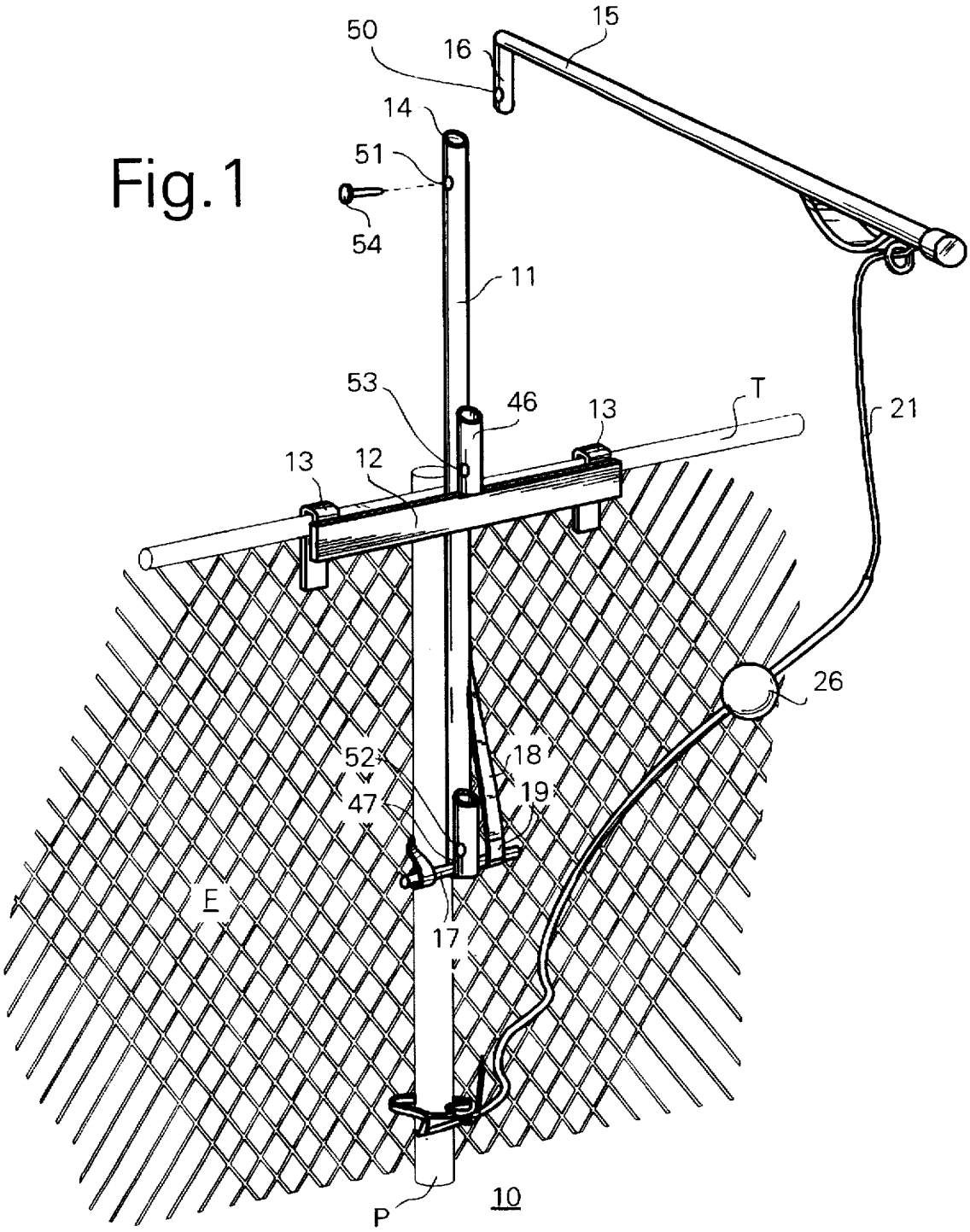
FIG. 1 is a perspective representational view of the training device for batters.

Referring now to FIGS. 1 through 9, the elements and features of the training device for batters will be more fully understood and appreciated. As shown in FIG. 1, training device for batters 10 includes generally upright member 11 having attached near its mid point and transverse to the axis of upright member 11, cross member 12. Attached to and extending from cross member 12 are a pair of hangers 13. Hangers 13 are set each at an equal and opposite distance transversely along cross member 12 from upright member 11. In the preferred embodiment of the invention, hangers 13 are configured in a generally U-shape.

Crossbar 17 is attached at the lower end of upright member 11 and provides both lateral support for upright member 11 and a point of purchase for a means for securing the upright member to fence F. In the preferred embodiment, the means for securing upright member 11 to fence F comprises support strap 18, which together with support buckle 19, are used to secure training device for batters 10 to a support structure. In the preferred embodiment of the invention, crossbar 17 lies transverse to the axis of upright member 11 and is adequate in length to provide effective lateral support for batter's training device 10 when in use.

In the preferred embodiment of the invention, a plurality of arm engagement mechanisms are formed along the length of upright member 11. Located along the length of upright member 11 are a lower arm engagement fitting 47 and a center arm engagement fitting 46 each configured to accept the sliding engagement of leg 16 which extends from arm 15. Additionally, in the preferred embodiment of the invention, upright member 11 is configured having an open upper end forming arm engagement socket 14. Lower arm engagement fitting 47 and center arm engagement fitting 46 each have a longitudinal axis which lies parallel to the longitudinal axis of upright member 11. In the preferred embodiment of the invention, arm engagement socket 14, lower arm engagement fitting 47 and center arm engagement fitting 46 are formed of a tubular section. In the preferred embodiment of the invention, arm engagement socket 14 is configured having aperture 51 formed therethrough, the aperture being perpendicular to the longitudinal axis of arm engagement socket 14. Similarly, lower arm engagement fitting 47 is configured having aperture 52 formed therethrough and center arm engagement fitting 46 is configured having aperture 53 formed therethrough, the apertures being perpendicular to the longitudinal axis of the respective arm engagement fittings.

Leg 16 extends generally perpendicularly from arm 15 and is slideably engageable within arm engagement socket 14, or alternately lower arm engagement fitting 47 or center arm engagement fitting 46. In the preferred embodiment of the invention, arm 15 is fabricated of a tubular section, typically a section of pipe or tubing, having an outside perimeter slightly less than the inside perimeter of arm engagement socket 14, the lower arm engagement fitting 47 and center arm engagement fitting 46. Leg 16 is configured having aperture 50 formed therethrough, the aperture being perpendicular to the longitudinal axis of leg 16. Aperture 50 corresponds with aperture 51 when leg 16 is slideably engaged within arm engagement socket 14. Similarly, aperture 50 corresponds with aperture 52 when leg 16 is slideably engaged within lower arm engagement fitting 47. Finally, aperture 50 corresponds with aperture 53 when leg 16 is slideably engaged within center arm engagement fitting 46. Pin 54 is placed through the pairs of corresponding apertures to secure leg 16 within any of the arm engagement mechanisms. Although the Figures depict arm engagement socket 14, the lower arm engagement fitting 47 and center arm engagement fitting 46 and leg 16 as having circular cross-sectional configurations, those skilled in the art will appreciate that any configuration which allows a snug sliding engagement between the outside perimeter of leg 16 and the inside perimeter of arm engagement socket 14, the lower arm engagement fitting 47 or center arm engagement fitting 46 will be acceptable.

Figure 2:
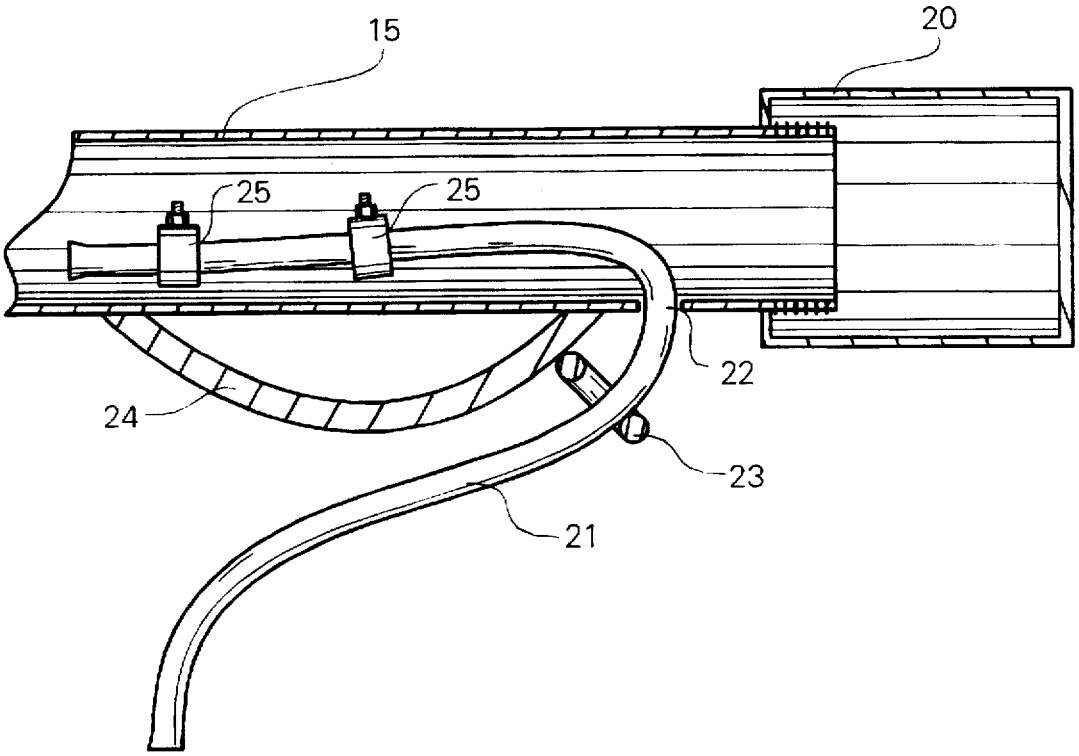
FIG. 2 is a cutaway representational view of a detail of the distal end of the arm of the training device for batters.

Referring to FIG. 2, cap 20 is shown located at the distal end of arm 15. In the preferred embodiment of the invention, cap 20 has a set of internal threads for cooperative fit with corresponding external threads located at the end of arm 15. Tether 21 is shown projecting through arm aperture 22 and through eye 23 affixed to strap 24. Clamps 25 secure the first end of tether 21 within arm 15.

Figure 3:
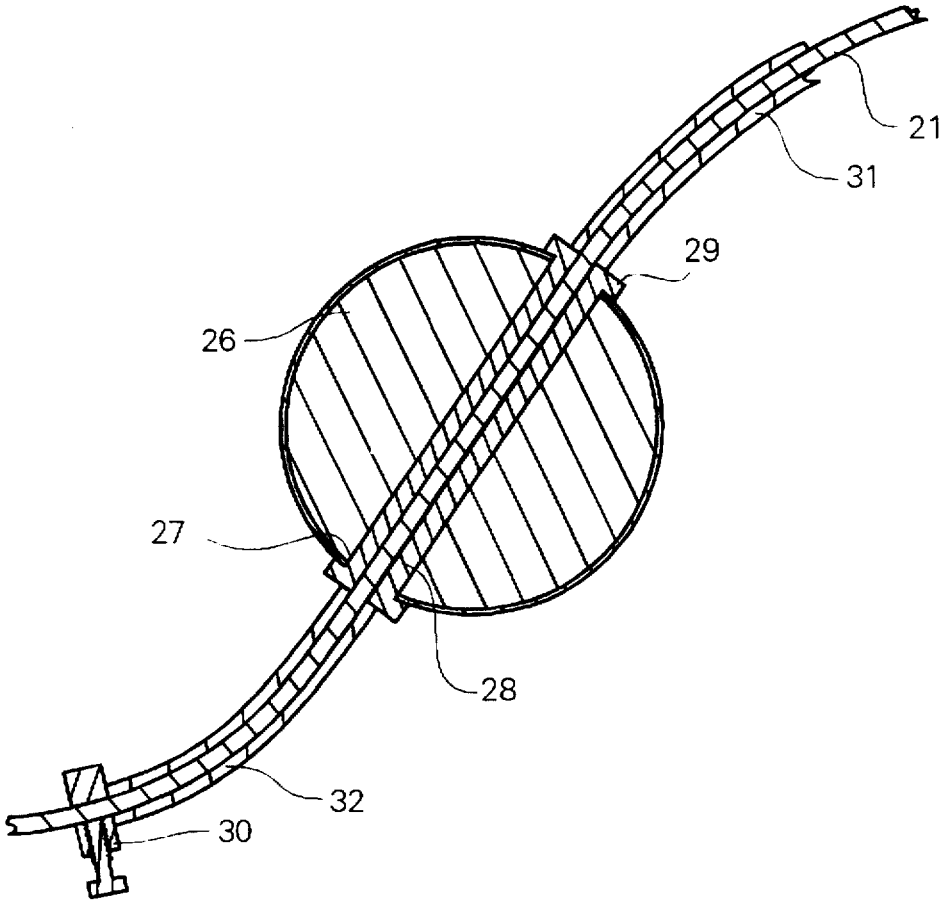
FIG. 3 is a cutaway representational view of the ball for the training device for batters.
Figure 4:
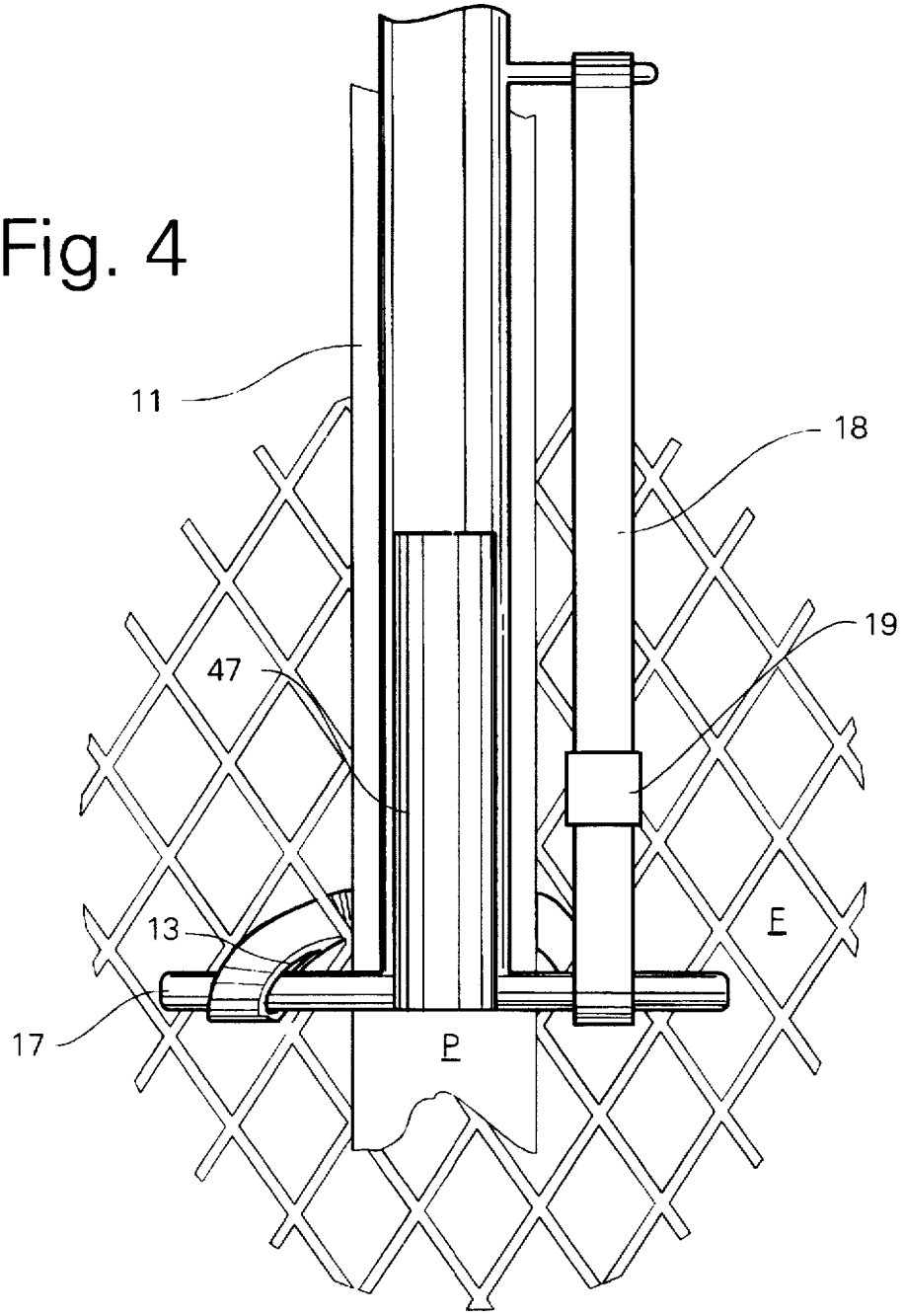
FIG. 4 is a perspective representational view of a detail of the support strap and buckle for the training device for batters.

Referring to FIG. 3, ball 26 having ball aperture 27 therethrough is slideably mounted along the length of tether 21. It has been found that the service life of the device is extended substantially by inserting ball sleeve 28 within ball aperture 27 and fixing ball sleeve 28 with collar 29. In the preferred embodiment of the invention, both ball sleeve 28 and collar 29 are fabricated of a malleable metal preferably an iron or aluminum alloy. The position, i.e., relative height, of ball 26 is adjustable using adjustable limit stop 30 which slideably engages tether 21. Upper tether sleeve 31 and lower tether sleeve 32 provide protection from impact to tether 21.

Figure 5:
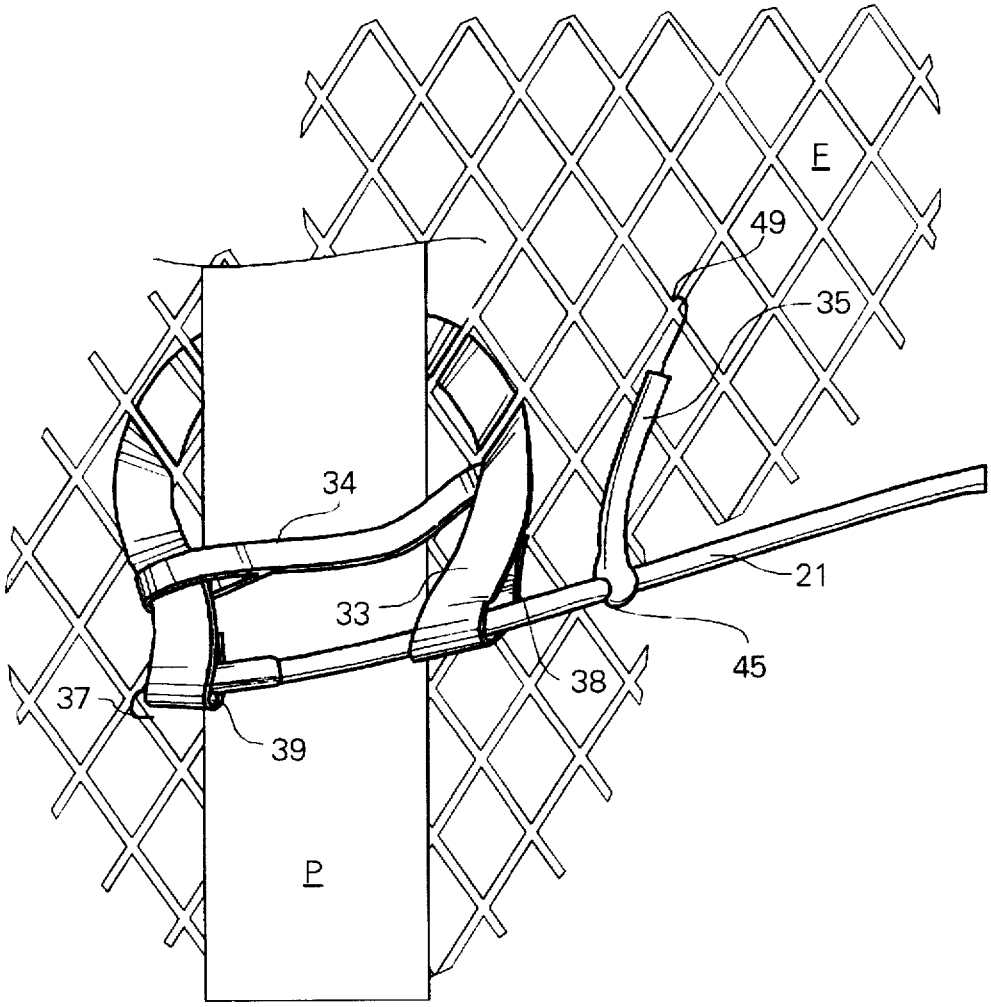
FIG. 5 is a perspective representational view of a detail of the elastomeric cord, tether strap and buckle for the training device for batters.

Referring to FIG. 5, a means for retaining the second end of tether 21 is attached at the second end of tether 21. In the preferred embodiment of the invention, the retaining means include hook 37 secured at the second end of tether 21, tether strap 33 and elastomeric cord 35 having eye 45 located at its first end for sliding engagement with tether 21 and cord hook 49 attached at its second end. Tether strap 33 is fabricated from a nylon strap or webbing and is configured having first end loop 38, second end loop 39 and midpoint loop 34. The second end of tether 21 and hook 37 also slideably engage elastomeric cord 35 through eye 36. The second end of tether 21 and hook 37 slideably engage tether strap 33 by passing through first end loop 38. Both tether strap 33 and elastomeric cord 35 are employed to secure tether 21 to a support structure, typically post P in the manner discussed below.

To employ training device for batters 10 for use, upright member 11 is attached to fence F by positioning hangers 13 over toprail T. Upright member 11 is secured for use by drawing support strap 18 down and across the front face of the first leg of crossbar 17 and wrapping support strap 18 around post P as detailed in FIG. 4. End loop 13 of support strap 18 passes over the second leg of crossbar 17. Support strap 18 is tightened to secure upright member 11 and support buckle 19 maintains the tension on support strap 18.

Figure 6:
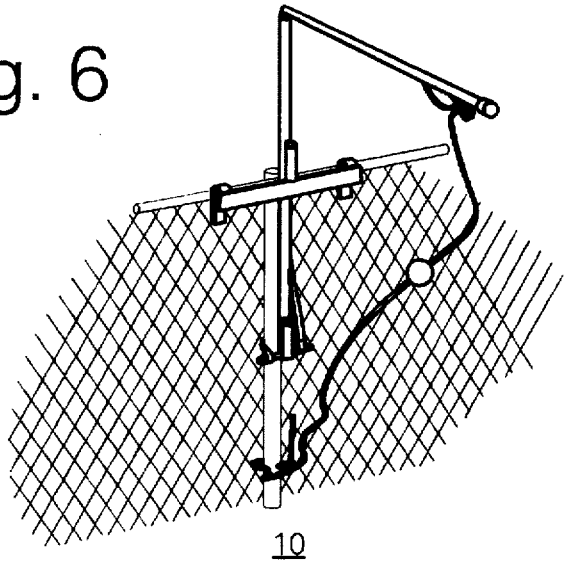
FIG. 6 is a perspective representational view of the training device for batters as erected in a first configuration.
Figure 7:
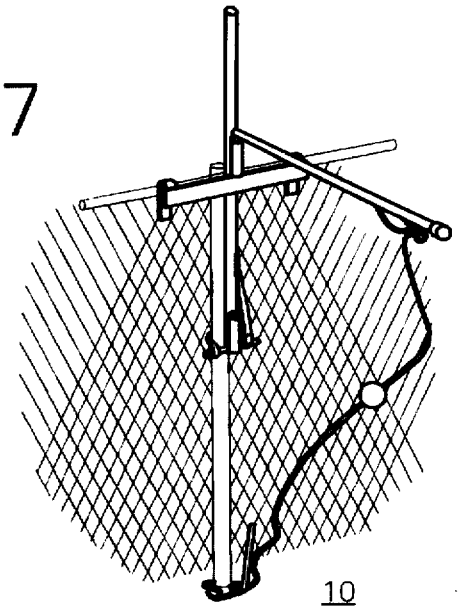
FIG. 7 is a perspective representational view of the training device for batters as erected in a second configuration.
Figure 8:
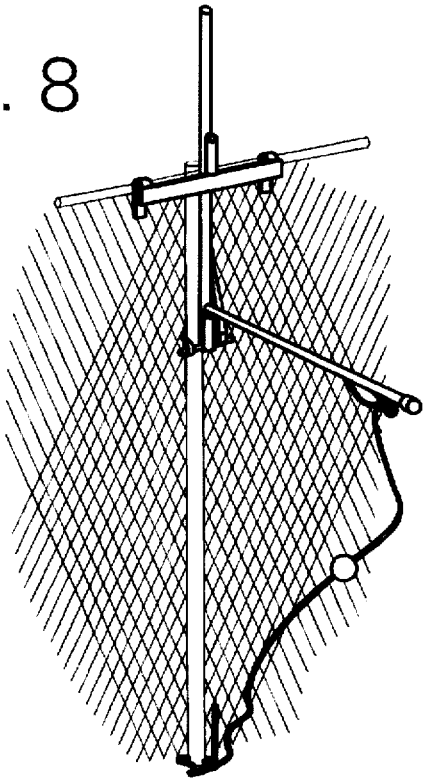
FIG. 8 is a perspective representational view of the training device for batters as erected in a third configuration.

Next, and depending upon the height of the fence to which training device for batters 10 is being attached, leg 16 of arm 15 is slideably engaged within arm engagement socket 14, as shown in FIGS. 1 and 6, or alternatively, center arm engagement fitting 46, as shown in FIGS. 1 and 7, or lower arm engagement fitting 47, as shown in FIGS. 1 and 8, to position arm 15 at the desired height, preferably above the height of the batter. Pin 54 is placed through the pairs of corresponding apertures to secure leg 16 within the selected arm engagement mechanism.

Referring now to FIG. 5, attachment of the second end of tether 21 to post P and fence F is detailed. Second end loop 39 of tether strap 33 is passed around and behind post P. Midpoint loop 34 is positioned across the front of post P. Second end loop 39 passes through midpoint loop 34 and finally, hook 37 engages second end loop 39. The assembly is tightened by pulling on the first end of tether strap 33 in order to tighten the noose which is formed as described around post P. Next, cord hook 49 of elastomeric cord 35 is engaged with fence F to limit travel of ball and tether in use.

Referring to FIG. 2, the length of tether 21 may be adjusted as required by removing cap 20 and withdrawing the first end of tether 21 from inside arm 15. Clamps 25 are loosened allowing tether 21 to be drawn through clamps 25 to provide the desired length for tether 21. Referring to FIG. 3, the height of ball 26 above the ground and along tether 21 is adjustable by loosening the clamping screw of adjustable limit stop 30 and sliding the same up or down tether 21.

Figure 9:
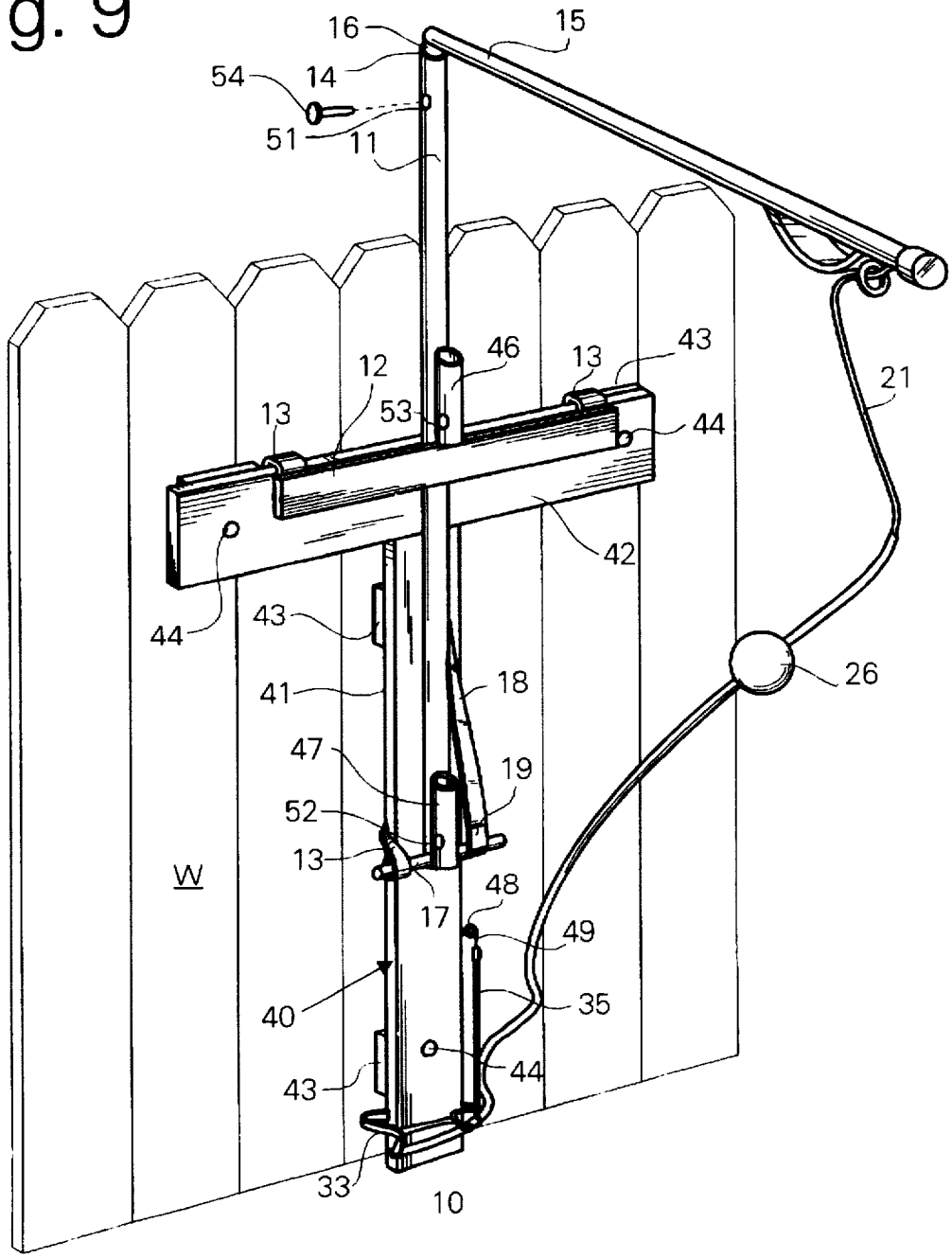
FIG. 9 is a perspective representational view of the training device for batters showing the adapter for mounting.

Referring to FIG. 9, an alternate embodiment of training device for batters 10 is shown mounted to wall W using adapter 40. Adapter 40 is employed in those instances where a support structure lacks a toprail and surface mounting is therefore required. Adapter 40 includes adapter upright member 41, adapter cross member 42, elevators 43 and adapter apertures 44. Elevators 43 serve to hold adapter 40 out and away from wall W at a predefined distance allowing clearance around adapter upright member 41 and adapter cross member 42 to accommodate placement of training device for batters 10 on adapter 40. Screws or other appropriate fastening means secure adapter 40 to the support structure, in this case wall W.

Referring to FIG. 9, training device for batters 10 may be mounted using adapter 40 in a manner similar to installing to a fence as described above. Adapter 40 is first secured to wall W using screws. Next, upright member 11 is attached to adapter 40 by positioning hangers 13 over adapter cross member 42. Upright member 11 is secured for use by drawing support strap 18 down and across the front face of the first leg of crossbar 17 and wrapping support strap 18 around adapter upright member 41 as detailed in FIG. 4. End loop 13 of support strap 18 passes over the second leg of crossbar 17. Support strap 18 is tightened to secure upright member 11 and support buckle 19 maintains the tension on support strap 18. Second end of tether 21 is secured for use as described above with the exception that second end loop 39 of tether strap 33 is passed around and behind adapter upright member 43. Cord hook 49 of elastomeric cord 35 engages adapter eyelet 48, attached to adapter 40, to limit travel of ball 26 when hit.

While there is shown and described the preferred embodiment of the invention, it is to be distinctly understood that this invention is not limited thereto but may be variously embodied to practice within the scope of the following claims.

We claim:

1. A training device for batters removably attachable to a support structure comprising:

an upright member;

at least one arm engagement fitting attached along the length of the upright member;

a cross member attached to the upright member transverse to the longitudinal axis of the upright member, the cross member including a hanger for attaching said upright member to a preexisting support structure;

an arm including a leg formed at a first end of the arm for sliding engagement with said at least one arm engagement fitting, the leg extending substantially perpendicularly from the arm;

a tether having a first end and a second end, the first end of the tether being attached at the second end of the arm, said second end being attached to the preexisting support structure for limiting travel of the second end of the tether; and a ball having an aperture formed therethrough and being slideably engaged along the tether.

2. The training device of claim 1 wherein said upright member is tubular and said leg is telescopically received in the upper end of said upright member.

3. The training device of claim 1 wherein the tether includes a limit stop for limiting travel of the ball along the tether.

4. The training device of claim 1 wherein the ball further comprises a sleeve located within the ball aperture, the sleeve having a collar for securing the sleeve within the ball aperture.

5. The training apparatus claimed in claim 1 wherein the means attaching said the upright member further include a support strap having a buckle for tensioning the strap.

6. The training devise of claim 1 wherein the means for limiting travel of the second end of the tether comprises a strap.

7. The training device of claim 1 wherein the means for limiting travel of the second end of the tether comprises an elastomeric cord.

8. The training device of claim 1 wherein the means for limiting travel of the second end of the tether comprises a strap and an elastomeric cord.

* * * * *